US007325600B2

(12) United States Patent
Sieben

(10) Patent No.: US 7,325,600 B2
(45) Date of Patent: Feb. 5, 2008

(54) COIL TUBING HANGER AND METHOD OF USING SAME

(75) Inventor: Donald Sieben, Red Deer (CA)

(73) Assignee: BJ Services Company, U.S.A., Houston, TX (US)

( * ) Notice: Subject to any disclaimer, the term of this patent is extended or adjusted under 35 U.S.C. 154(b) by 176 days.

(21) Appl. No.: 11/057,214

(22) Filed: Feb. 15, 2005

(65) Prior Publication Data

US 2006/0180317 A1 Aug. 17, 2006

(51) Int. Cl.
*E21B 33/04* (2006.01)

(52) U.S. Cl. ..... 166/88.3; 166/382

(58) Field of Classification Search ..... 166/88.1, 166/88.3, 88.4, 212, 382, 77.2, 89.3, 208
See application file for complete search history.

(56) References Cited

U.S. PATENT DOCUMENTS 4,646,827 A * 3/1987 Cobb ..... 166/88.2
5,092,400 A 3/1992 Jagert ..... 166/88
5,522,464 A * 6/1996 Piper ..... 166/77.2
5,727,631 A * 3/1998 Baker et al. ..... 166/379

FOREIGN PATENT DOCUMENTS

CA 1276546 11/1990 ..... 166/62

* cited by examiner

*Primary Examiner*—David Bagnell
*Assistant Examiner*—Daniel P Stephenson
(74) *Attorney, Agent, or Firm*—Howrey LLP

(57) ABSTRACT

A coil tubing hanger includes a hanger body having a hanger base with a lower end for connection to a well tree, an upper end for connection of a hanger cap and an internal cylindrical cavity for receiving an annular, externally actuated, pack-off element for selectively providing a high-pressure fluid seal against the coil tubing. The hanger cap seals the cylindrical cavity and provides a slip bowl. Slips received in the slip bowl suspend the coil tubing. An injection nipple mounted to the slip bowl includes an injection nipple port through which the coil tubing extends, and a surface pack-off provides a high pressure fluid seal around the coil tubing above the slips, so that the pack-off element may be released from the coil tubing after the coil tubing is landed and the surface pack-off is secured.

17 Claims, 3 Drawing Sheets

COIL TUBING HANGER AND METHOD OF USING SAME

CROSS-REFERENCE TO RELATED APPLICATIONS

This is the first application filed for the present invention.

MICROFICHE APPENDIX

Not Applicable.

TECHNICAL FIELD

The present invention relates generally to well servicing equipment and methods, and in particular relates to an arrangement for supporting and packing off a coil tubing string within a well.

The demand for well servicing equipment has increased with the development of new techniques for stimulating production of oil and gas from well bores, and for treating production zones to improve extraction of hydrocarbons. Methods of treating production zones are well known in the art and typically involve continuously injecting small amounts of additives (e.g. surfactants, solvents, corrosion inhibitors, fluid system foamers, etc. using special tubing strings. Additives may be used to efface paraffin build-up, to remove salt accumulations, to free gas from water in the production zone, etc. Advantageously, coil tubing of relatively small diameter, known as "capillary coil tubing" or "spaghetti string", can be used for injecting additives into live wells. The use of capillary coil tubing permits downhole treatment fluids to be delivered while the well is in production without impeding flow within the casing or production coil tubing.

Various coil tubing hanger structures have been designed to permit the insertion of a coil tubing string into a live well. Some prior art coil tubing hangers incorporate externally actuated pack-off elements. Externally actuated pack-off elements seal against a coil tubing when actuated. For example, an annular pack-off element that is both hydraulically actuated by controlling pressure in a pressure retaining pocket, and actuated by mechanical force induced by compression in the axial direction, is taught in U.S. Pat. No. 5,092,400 to Jagert. The pack-off element is located below the slip bowl permitting a coil tubing string to be run in under live well conditions.

In most of the coil tubing hangers that incorporate externally actuated pack-off elements, the pack-off elements are above the casing bowl. This arrangement limits insertion operations, and it is impossible to land, or remove the coil tubing without killing or plugging the well.

It has been discovered that externally actuated pack-off elements, when subjected to forces required to seal around coil tubings for an extended period of time, tend to bond to the tubing. This bonding destroys the pack-off element, and frequently makes it very difficult to withdraw the coil tubing from the well.

Consequently there remains a need for a coil tubing hanger that can be used to suspend coil tubing in a well with a natural pressure greater than one atmosphere, while permitting safe, long term use and easy withdrawal of the tubing string even after an extended service life.

SUMMARY OF THE INVENTION

It is therefore an object of the invention to provide a method and apparatus for using an externally actuated pack-off element to expedite insertion and removal of coil tunings in a live well.

In accordance with an aspect of the invention a coil tubing hanger and pack-off assembly is provided that includes both an externally actuated pack-off element below a slip bowl, and a surface pack-off selectively mounted above the slips, both of which providing a high pressure fluid seal around the coil tubing. The surface pack-off above the slip bowl permits the release of the externally actuated pack-off element after the coil tubing is landed and an injection nipple is mounted to the hanger. The externally actuated pack-off element is used to seal off an annular space around the coil tubing only after the coil tubing has been inserted into the well, and landing of the coil tubing into the coil tubing hanger is desired, or when the coil tubing is being unseated from the coil tubing hanger.

More specifically, there is provided a coil tubing hanger for running a coil tubing into or out of a live well, comprising: a hanger body that houses an externally actuated annular pack-off element used to selectively provide a high pressure fluid seal in sealing engagement with the coil tubing, and supports tubing slips above and independently of the annular sealing element; and an injection nipple mounted to the hanger body and enclosing the slips, the injection nipple having an injection nipple port through which the coil tubing is run and a surface pack-off received in the injection nipple port, the surface pack-off providing a high pressure fluid seal around the coil tubing to permit the annular pack-off element to be released from sealing engagement with the coil tubing.

In accordance with another aspect of the invention, there is provided a method for running a coil tubing into a live well, the method comprising: mounting a coil tubing hanger body to a control stack of the well above a closed valve in the control stack, the coil tubing hanger body having an externally actuated annular pack-off element for selectively providing a high pressure fluid seal around the coil tubing below a slip bowl supported independently of the sealing element; mounting a coil tubing lubricator to a top end of the coil tubing hanger body; equalizing well pressure between the coil tubing lubricator and the control stack; opening the valve and injecting the coil tubing through the coil tubing hanger and into the live well to a desired depth; actuating the annular pack-off element to seal around the coil tubing within the coil tubing hanger; releasing pressure in the lubricator and removing the lubricator from the coil tubing hanger body; placing tubing slips in the slip bowl and securing the tubing slips to the coil tubing; mounting an injection nipple to the coil tubing hanger body, the injection nipple providing a surface pack-off around the coil tubing; and releasing the pack-off element seal around the coil tubing.

BRIEF DESCRIPTION OF THE DRAWINGS

Further features and advantages of the present invention will become apparent from the following detailed description, taken in combination with the appended drawings, in which.

It should be noted that throughout the appended drawings, like features are identified by like reference numerals.

DETAILED DESCRIPTION OF THE PREFERRED EMBODIMENT

The invention provides a coil tubing hanger and pack-off assembly that includes both an externally actuated pack-off element located below an independently supported slip bowl of the coil tubing hanger, and a surface pack-off above the slips, both of which provide a high pressure fluid seal around the coil tubing. The surface pack-off above the slip bowl permits the release of the externally actuated pack-off element after the coil tubing is landed and an injection nipple is mounted to the hanger. The externally actuated annular pack-off element may be used to seal off an annular space around the coil tubing after the coil tubing has been inserted into the well to a predetermined depth, and landing of the coil tubing into the coil tubing hanger is desired, or when the coil tubing is being removed from the well. Advantageously, the system permits coil tubing of different diameters to be inserted into a live well, including capillary coil tubing. Since the annular pack-off element can be released after the coil tubing is landed, bonding between the annular pack-off element and the coil tubing is avoided. Furthermore, the surface seal is maintained by the surface pack-off using O-ring seals, so there is no reliance on a hydraulically pressurized seal. Safety and reliability are thereby improved.

Figure 1:
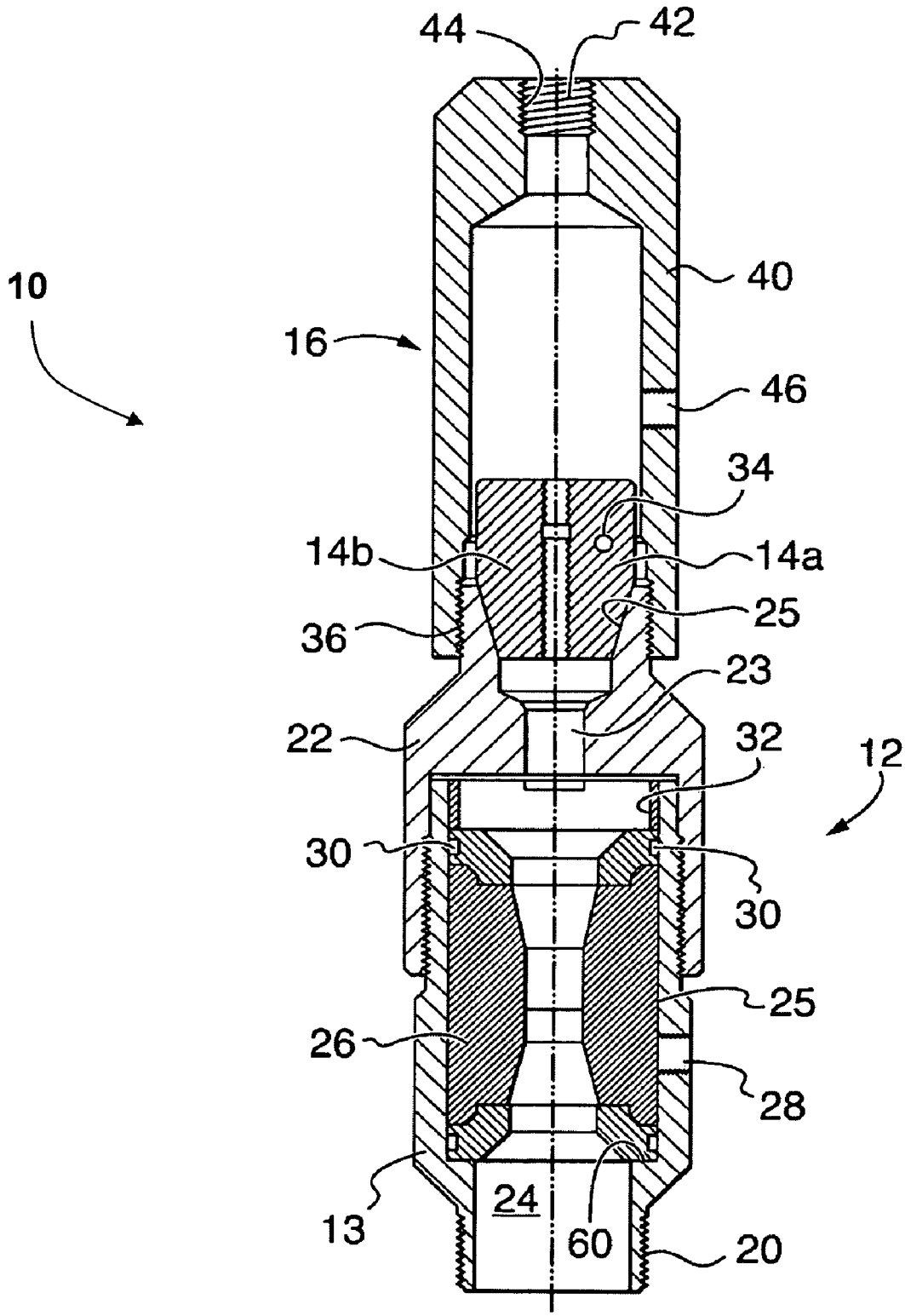
FIG. 1 is a schematic cross-sectional diagram of an embodiment of a coil tubing hanger in accordance with the invention.

FIG. 1 schematically illustrates an embodiment of a coil tubing hanger 10 in accordance with the invention. The coil tubing hanger 10 includes a hanger body 12, a set of slips 14, and an injection nipple 16.

The hanger body 12 includes a hanger base 13 with a pin threaded bottom end 13 for connecting to a casing head, or to a control stack above a casing head, for example. Typically, the bottom end 20 of the coil tubing hanger 12 is mounted to a control stack above at least one valve for shutting off fluid communication between the well and the coil tubing hanger 12.

While the illustrated bottom end 20 of the hanger base 13 includes a pin-threaded connector, it will be appreciated by those skilled in the art that a box-threaded connector, hammer union, stud pad, flange, or other connector type can also be used. The hanger body 12 further includes a hanger cap 22. The hanger cap 22 has an axial passage 23 that is in fluid communication with an internal passage 24 that extends downwardly from the axial passage 23 through the hanger base 12.

An externally actuated annular pack-off element 26 is housed in a cylindrical cavity 25 in the hanger base 13. The annular pack-off element 26 can be hydraulically or pneumatically actuated to seal off around a coil tubing to permit certain operations during the coil tubing installation, as will be explained below in more detail with reference to FIG. 3. The embodiment of the annular pack-off element 26 is externally actuated by controlling a fluid pressure via hydraulic port 28 in the cylindrical wall of the hanger base 13.

In order to prevent pressurized fluid from escaping from the internal passage 24, an O-ring seal 30 is provided between threaded mating walls of the hanger body cap 22 and hanger base 13. It will be appreciated by those skilled in the art that other arrangements for securely connecting the hanger cap 22 and hanger base 13, while providing a fluid-tight seal have been contemplated. A retainer ring 32 that threadedly engages a box thread cut in a top end of interior walls of the cylindrical cavity 25 retains the pack-off element 26 in the cylindrical cavity 25. O-rings 31 and 33 at the top and bottom of the annular pack-off element 26 provide a high pressure fluid seal to prevent well pressure from escaping through the hydraulic port 28.

The coil tubing hanger 12 uses a set of three tubing slips 14, only two 14*a*, 14*b* of which are shown, to suspend the coil tubing in a well. Slips 14 typically have contoured outer surfaces that mate with an inner surface of the slip bowl 25 formed in a top of the hanger cap 22, such that a wedging action induced by a weight borne by the slips 14 tighten a grip of the slips 14 on the coil tubing. The slips 14*a,b* have internal surfaces for bi-directionally gripping the coil tubing. In the illustrated embodiment, the slips 14 are connected to the coil tubing by set screws 34, which are manually tightened using an appropriate Allen key, or the like.

The hanger cap 22 includes a pin thread 36 disposed circumferentially around the slip bowl 25 for secure, sealed, threaded coupling of an injector nipple 40. As shown, the injector nipple 40 is a hollow cylindrical piece having an injection nipple port 42 in a top end, and a cylindrical wall defining an axial passage communicating with the injector port 42. The bottom end of the cylindrical wall includes a box thread that is complementary with the pin thread 36 of the hanger cap 22.

Figure 2:
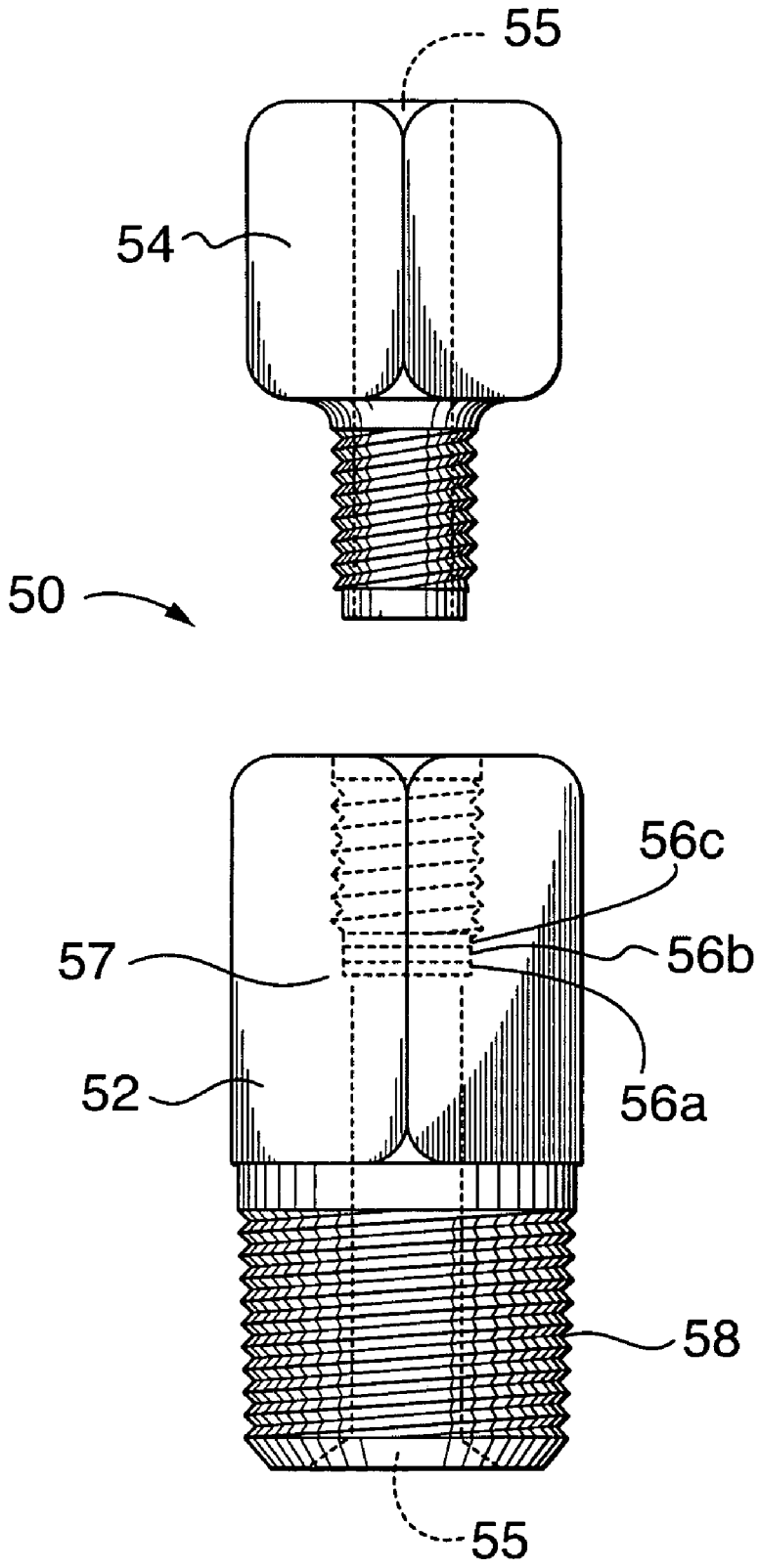
FIG. 2 is an exploded view of an embodiment of a surface pack-off for the coil tubing hanger shown in FIG. 1.

The injector nipple port 42 includes a box thread 44 for receiving a surface pack-off shown in FIG. 2. The injector nipple 40 provides a sealed annular space around the coil tubing when the coil tubing passes through the injector nipple port 42 and the surface pack-off is installed. A bleed port 46 is provided to permit equalization of pressure within the injector nipple 40 when desired.

FIG. 2 schematically illustrates a surface pack-off 50 in accordance an embodiment of the invention. The surface pack-off 50 includes a first fitting 52 and a second fitting 54, which cooperate to define a sealed axial passage 55 through which the coil tubing passes. The second fitting 54 secures high pressure fluid seals 56*a*-56*c* in within a seal chamber 57 to provide a high pressure fluid seal around the coil tubing. While there are various options available for providing such a high pressure fluid seal, seals 56*a*, 56*b*, 56*c* are O-rings. In this embodiment, seals 56*a* and 56*c* are backup Teflon® O-rings and seal 56*b* is a highly saturated nitrile (HSN) O-ring. The first fitting 52 has a bottom pin thread 58 for connection to the box thread 44 of the injection nipple port 42 of the injection nipple 40. It will be appreciated by those skilled in the art that the first fitting 52 and the second fitting 54 may be provided with axial passages 55 and a seal chamber 57 of any diameter required for a corresponding diameter of coil tubing, thus permitting the coil tubing hanger 10 to be used with a range of different diameters of coil tubing.

It should be understood that in other embodiments the seal chamber may be provided directly within the injection nipple port 42, in order to reduce a part count. However, doing so restricts the injection nipple 40 to use with a coil tubing of a given diameter.

Figure 3:
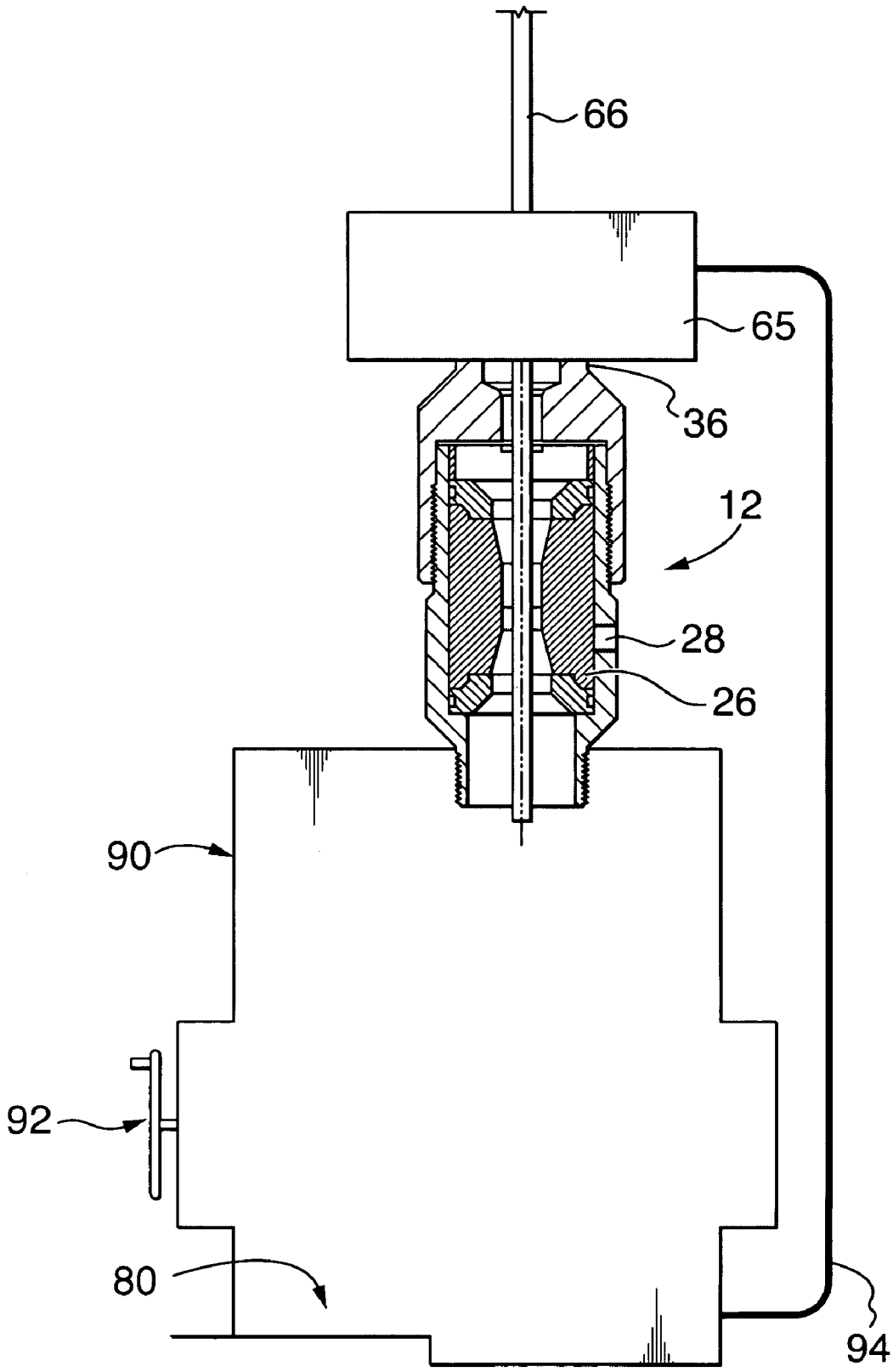
FIG. 3 is a schematic diagram of a lubricator connected to the coil tubing hanger body shown in FIG. 1, the lubricator being used to run coil tubing into a live well or withdraw the coil tubing from the well.

As shown in FIG. 3, the coil tubing hanger 10 can be used to insert a coil tubing 66 into a live well 80. The hanger body 12 is connected to any suitable port or adapter on a control stack 90 of the live well 80 above a closed flow control valve 92. A lubricator 65 is connected directly, or with an adapter, to the pin thread 36 of the hanger body 12. After the lubricator 65 is connected to the hanger body 12, the coil tubing 66 is inserted into the lubricator 65 and the down through the hanger body 12 to the closed valve 92. The lubricator 65 provides a required seal to permit insertion of the coil tubing 66 under well pressure conditions.

A high pressure line 94 is then connected to a port on the control stack below the closed valve 92 and a port on the lubricator 65 and well pressure is balanced across the closed valve 92 in a manner well known in the art. The valve 92 is then opened and a coil tubing injector (not shown) is operated to injected a desired length of coil tubing into the well. After the coil tubing 66 is injected to a desired depth in the live well, the pack-off element 26 is actuated by introducing pneumatic or hydraulic fluid through port 28, as described above, to seal off around the coil tubing 66. Pressure is then bled from the lubricator 65 and the lubricator 65 is removed. The slips 14 are seated within the slip bowl 25 and secured about the coil tubing 66 as described above. The coil tubing is then threaded through the injection nipple port 42 of the injection nipple 40, and the injection nipple 40 is connected to hanger body 12. The first fitting 53 and the second fitting 54 of the surface pack-off are then installed in the injection nipple port 42 to provide a high pressure fluid seal to prevent well fluids from escaping to atmosphere. Pressure is then preferably balanced by connecting the high pressure line 94 between the bleed port 46 (FIG. and the port on the control stack, as explained above. After the pressure is balanced, hydraulic pressure on the pack-off element 26 is released.

The coil tubing hanger 10 can be used to suspend any coil tubing, including a capillary coil tubing frequently referred to as a "spaghetti string" within a live well. Since the annular pack-off element 26 is always released prior to long term service in the well, removal of the coil tubing from the well does not pose a problem because there is no possibility of developing a bond between the coil tubing and the annular pack-off element 26. Furthermore, because the surface pack-off is provided by the O-ring seals 56*a*-56*c*, there is no reliance on a seal that could de-pressureize over time and fail. Safety and reliability are therefore significantly enhanced.

The embodiments of the invention described above are intended to be exemplary only. The scope of the invention is therefore intended to be limited solely by the scope of the appended claims.

I claim:

1. A coil tubing hanger for running a coil tubing into or out of a live well, comprising:

a hanger body that houses an externally actuated annular pack-off element used to selectively provide a high pressure fluid seal in sealing engagement with the coil tubing, and supports tubing slips above and independently of the annular sealing element; and an injection nipple mounted to the hanger body and enclosing the slips, the injection nipple having an injection nipple port through which the coil tubing is run and a surface pack-off received in the injection nipple port, the surface pack-off providing a high pressure fluid seal around the coil tubing to permit the annular pack-off element to be released from sealing engagement with the coil tubing, wherein the hanger body comprises a hanger base having a bottom end that connects to a well tree of the live well and a sidewall that extends upwardly from the bottom end and defines a cylindrical cavity for housing the annular pack-off element, and wherein the hanger body further comprises a hanger cap having a depending bottom sidewall that threadedly connects to the outside of the sidewall of the hanger base, a slip bowl in a top end thereof and an axial fluid passage that communicates with the slip bowl and the cylindrical cavity in the hanger base.

2. The coil tubing hanger as claimed in claim 1 wherein the injection nipple threadedly connects to a pin thread on an outer wall of a top end of the hanger cap.

3. The coil tubing hanger as claimed in claim 2 wherein the injection nipple further comprises a bleed port for releasing or equalizing well pressure above the tubing slips in the injection nipple.

4. The coil tubing hanger as claimed in claim 1 wherein the surface pack-off comprises first and second fittings.

5. The coil tubing hanger as claimed in claim 4 wherein the first fitting is threadedly connected to the injection nipple and has an axial passage through which the coil tubing passes, the axial passage including a seal chamber for receiving at least one high pressure fluid seal that seals around the coil tubing to permit the annular pack-off element to be released from sealing engagement with the coil tubing.

6. The coil tubing hanger as claimed in claim 5 wherein the second fitting is threadedly connected to the first fitting, and the second fitting has an axial passage through which the coil tubing passes and a bottom end that closes a top of the seal chamber to retain the at least one fluid seal in the seal chamber.

7. The coil tubing hanger as claimed in claim 5 wherein the at least one high pressure fluid seal comprises at least one O-ring.

8. A coil tubing hanger, comprising:

a hanger body base having a bottom end for connection to a well tree of a well, an upper end for connection of a hanger body cap, and an internal cavity for receiving an externally actuated, annular pack-off element for selectively providing a high-pressure fluid seal around the coil tubing;

tubing slips for suspending the coil tubing received in a slip bowl formed in a top end of the hanger body cap;

an injection nipple mounted to the hanger body cap and including an injection nipple port through which the coil tubing passes; and a surface pack-off providing a high pressure fluid seal around the coil tubing above the tubing slips, so that the pack-off element may be released after the coil tubing is landed and the surface pack-off is secured to provide the high pressure fluid seal above the tubing slips, wherein the surface pack-off is threadedly connected to the injection nipple port.

9. The coil tubing hanger as claimed in claim 8 further comprising a retainer ring received in the internal cavity above the annular pack-off element for securing the annular pack-off element in a bottom of the internal passage.

10. The coil tubing hanger as claimed in claim 8 wherein the hanger body cap supports the connection of a lubricator used to run the coil tubing into or out of the well.

11. A coil tubing hanger, comprising:

a hanger body base having a bottom end for connection to a well tree of a well, an upper end for connection of a hanger body cap, and an internal cavity for receiving an externally actuated, annular pack-off element for selectively providing a high-pressure fluid seal around the coil tubing;

tubing slips for suspending the coil tubing received in a slip bowl formed in a top end of the hanger body cap;

an injection nipple mounted to the hanger body cap and including an injection nipple port through which the coil tubing passes;

a surface pack-off providing a high pressure fluid seal around the coil tubing above the tubing slips, so that the pack-off element may be released after the coil tubing is landed and the surface pack-off is secured to provide the high pressure fluid seal above the tubing slips; and a bleed port for selectively depressurizing an annular space around the coil tubing, the bleed port being located above the annular pack-off element and below the surface pack-off.

12. A coil tubing hanger and pack-off assembly as claimed in claim 11 wherein the injection nipple further comprises: a cylindrical wall defining an axial passage communicating with the surface pack-off at a top end thereof, and threadedly connected at the bottom end to the hanger body cap; and the bleed port that extends radially through the cylindrical wall.

13. A coil tubing hanger, comprising:

a hanger body base having a bottom end for connection to a well tree of a well, an upper end for connection of a hanger body cap, and an internal cavity for receiving an externally actuated, annular pack-off element for selectively providing a high-pressure fluid seal around the coil tubing;

tubing slips for suspending the coil tubing received in a slip bowl formed in a top end of the hanger body cap;

an injection nipple mounted to the hanger body cap and including an injection nipple port through which the coil tubing passes; and a surface pack-off providing a high pressure fluid seal around the coil tubing above the tubing slips, so that the pack-off element may be released after the coil tubing is landed and the surface pack-off is secured to provide the high pressure fluid seal above the tubing slips, wherein the surface pack-off comprises:

one of a plurality of first fittings respectively adapted to pack-off a predetermined diameter of the coil tubing, each of the first fittings including an axial passage for receiving a predetermined diameter of the coil tubing and a seal chamber for receiving and supporting a high pressure fluid seal for providing the surface pack-off; and one of a plurality of second fittings respectively paired with the plurality of first fittings and having a central passage dimensioned to receive the predetermined diameter of coil tubing, the second fittings comprising a pin thread for engaging a box thread in a top of the axial passage through the first fittings and a bottom end below the pin thread for closing a top of the seal chamber to retain the high pressure fluid seal in the seal chamber.

14. A method for running a coil tubing into a live well, the method comprising:

mounting a coil tubing hanger body to a control stack of the well above a closed valve in the control stack, the coil tubing hanger body having an externally actuated annular pack-off element for selectively providing a high pressure fluid seal around the coil tubing below a slip bowl supported independently of the sealing element; mounting a coil tubing lubricator to a top end of the coil tubing hanger body;

equalizing well pressure between the coil tubing lubricator and the control stack; opening the valve and injecting the coil tubing through the coil tubing hanger and into the live well to a desired depth;

actuating the annular pack-off element to seal around the coil tubing within the coil tubing hanger;

releasing pressure in the lubricator and removing the lubricator from the coil tubing hanger body;

placing tubing slips in the slip bowl and securing the tubing slips to the coil tubing;

mounting an injection nipple to the coil tubing hanger body, the injection nipple providing a surface pack-off around the coil tubing; and releasing the pack-off element seal around the coil tubing.

15. The method as claimed in claim 14 further comprising balancing well pressure between the control stack and the injection nipple by connecting a high pressure line between a port on the control stack and a bleed port on the injection nipple prior to releasing the pack-off element seal around the coil tubing.

16. The method as claimed in claim 14 wherein actuating the annular pack-off element comprises connecting an hydraulic line to an hydraulic port on a side of the hanger body and pumping hydraulic fluid into the hanger body until a predetermined fluid pressure is achieved.

17. The method as claimed in claim 14 wherein securing the tubing slips comprises manually tensioning set screws to secure the tubing slips to the coil tubing.

* * * * *